United States Patent [19]

Heil et al.

[11] 4,249,546

[45] Feb. 10, 1981

[54] APPARATUS FOR FILLING EMPTY CIGARETTE TUBES

[75] Inventors: Richard Heil; Klaus Gätschmann; Anton Wieshofer, all of Trossingen, Fed. Rep. of Germany

[73] Assignee: Efka-Werke Fritz Kiehn GmbH, Trossingen, Fed. Rep. of Germany

[21] Appl. No.: 62,232

[22] Filed: Jul. 27, 1979

[30] Foreign Application Priority Data

Aug. 1, 1978 [DE] Fed. Rep. of Germany ..... 2833681

[51] Int. Cl.[3] ..... A24C 5/02; A24C 5/42

[52] U.S. Cl. ..... 131/70

[58] Field of Search ..... 131/70, 71, 72, 75

[56] References Cited

U.S. PATENT DOCUMENTS 3,202,156 8/1965 Kappeler et al. ..... 131/70

3,509,887 5/1970 Kappeler et al. ..... 131/70

3,721,247 3/1973 Paynter ..... 131/72

*Primary Examiner*—Stephen C. Pellegrino

*Attorney, Agent, or Firm*—Browdy and Neimark

[57] ABSTRACT

An apparatus for filling empty cigarette blanks in which tobacco is placed in a tobacco magazine. When an operating lever is actuated, a pressure plate compresses the tobacco into a column. Upon further actuation of the lever, an elastic rack expels these columns so formed through a boss on which the cigarette blank is held by pincers. In order to adapt the apparatus to cigarette blanks of various lengths, in particular to cigarette blanks having single or dual filters, there is provided a movable slide which limits the amount of tobacco placed in the tobacco magazine to correspond to the amount required by a particular cigarette blank.

5 Claims, 5 Drawing Figures

APPARATUS FOR FILLING EMPTY CIGARETTE TUBES

FIELD OF THE INVENTION

The invention relates to apparatus for filling cigarette blanks, i.e., empty paper sleeves, with tobacco. More particularly, the invention relates to a manually operated device in which the user fills one cigarette blank at a time by actuating an operating lever.

BACKGROUND OF THE INVENTION

Apparatus for filling cigarette blanks with tobacco are known in the art, for example from the U.S. Pat. No. 3,509,887. The apparatus described there includes a tobacco pressure plate and a tobacco expeller which is actuated by means of a rack and pinion drive.

The empty cigarette blanks which are commercially available include those equipped with only a cardboard tip as well as those provided with a tobacco smoke filter in the tip. In order to further decrease the nicotine and tar content of the tobacco smoke, the manufacturers of cigarette blanks have also offered blanks with a double filter, i.e., a filter of approximately twice the length of previously known filters. When such double filter cigarette blanks are used in the known cigarette making machines, the reduced free space for admitting tobacco causes difficulties in their use.

It is known in the art to adjust the path of the tobacco expeller to various blank lengths. However, even these adjustments cannot overcome the difficulty which occurs when, for the same length of the blank, the free space for receiving tobacco is reduced due to the presence of the double filter.

OBJECT AND SUMMARY OF THE INVENTION

It is thus an object of the present invention to provide an apparatus for filling empty cigarette blanks which is capable of simple and arbitrary selection to accommodate single filter blanks as well as dual filter blanks.

This object is attained according to the invention by providing that the usable volume of the tobacco storage magazine can be diminished by a locking lever. In this way, the length of the tobacco column which is expelled can be varied and adjusted to the available space in the blank. Because of the provisions of the invention, the filled cigarette blank does not require further treatment nor is tobacco wasted.

One advantageous embodiment of the invention provides a slide which partially covers the tobacco storage magazine.

Suitably, this slide may be displaced in the longitudinal direction of the tobacco storage magazine.

In one preferred embodiment of the invention, the slide moves in grooves parallel to a receiver opening and the ends of the grooves have stops which correspond to at least two different lengths of tobacco columns. In still another embodiment of the invention, the tobacco pressure plate can be shortened by telescoping.

Suitably and advantageously, the apparatus includes a clamping device which holds the cigarette blank on a tubular boss under the control of the operating lever.

Other advantages and characteristics of the invention will emerge from a reading of the detailed description of the preferred embodiments in conjunction with the drawing.

DESCRIPTION OF THE PREFERRED EMBODIMENTS

Figure 1:
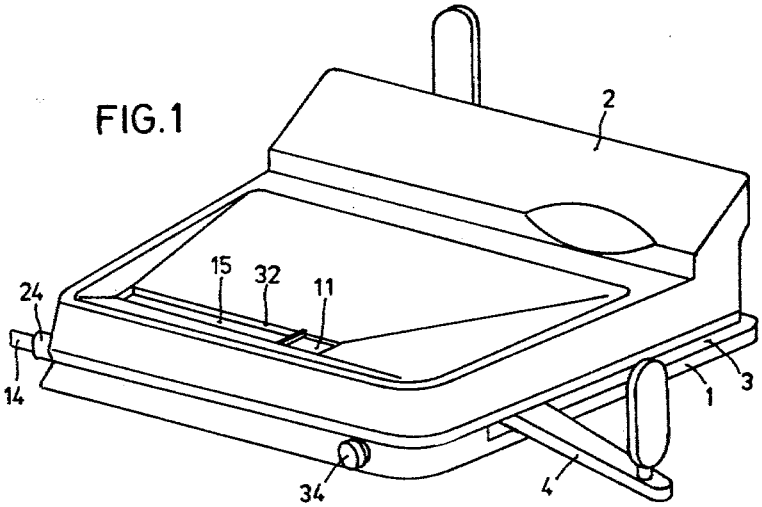
FIG. 1 is a perspective front view of the apparatus of the invention.

The apparatus illustrated in FIG. 1 includes a housing consisting of a housing base 1 and a housing top 2 which may be placed and mounted thereon. An operating lever 4 pivots around a shaft 5 and protrudes from a slot 3 of the base 1. The operating lever 4 carries a circular segment 6 having a first part 28 with a smooth periphery and a contiguous second part with external gear teeth. In the first phase of the motion of the operating lever, the smooth part 28 passes gears 7, 8 without engagement while the pressure plate 16 is moved forward and thereafter, the gear portion of the circular segment 6 engages the gear train 7, 8, 9 for the purpose of advancing the rack 10. The rack 10 serves to expel the column of tobacco formed in the apparatus and is seen to be made from an elastic material capable of assuming a curvature. The gear 7 may be temporarily blocked by a recess 33 which receives the segment 28.

The pinion 9 passes through an opening 29 in the tubular guide 30 which guides the rack 10. At the end nearest the tobacco magazine, the rack 10 has a tab 14 which extends into the tobacco magazine 15 in the terminal position of the rack and which exits from the blank-holding boss 24 together with the tobacco column.

Located within the tobacco magazine 15 is a displaceable pressure plate 16 provided with lateral geared rods 17 which engage partially geared drive gears 18 attached to the operating lever 4. The gears 18 also carry cams 19 which glide on the arched rear portion of the tobacco pressure plate 16 for the purpose of locking the plate 16 in its compressive position once the toothed portion of the gears 18 leaves the engagement with the geared rods 17. The cams 19 may be so shaped that in the final compressive position the radial force exerted on the pressure plate 16 is actually slightly reduced to relieve the resistance of the pressure plate to the expulsion of the tobacco column. A further cam 20 attached to one of the gears 18 engages a double lever 21 which moves a slide 22 against the force of a spring 23. The slide 22 actuates pincers 25 associated with the blank-holding boss for holding and releasing a cigarette blank slipped over the boss 24.

Figure 2:
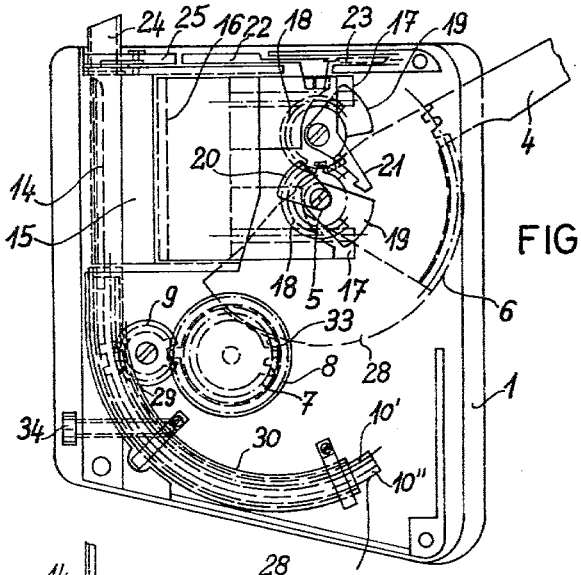
FIG. 2 is a top view of the apparatus of the invention with the cover removed and the operating lever in the initial position.

In the embodiment according to FIG. 2, the rack 10 is a rod of circular cross section and constructed of an elastic plastic material. The rod 10 has gear teeth 10' along the side facing the pinion 9. Suitable relief depressions 10'' on the opposite side serve to diminish resistance to bending.

In order to illustrate the operation of the apparatus, let it be assumed that the operating lever 4 is in the initial position illustrated in FIG. 2. In that position, the tobacco storage magazine is open and the tobacco expeller rod 10 is in its terminal position as illustrated. In this state, the tobacco magazine 15 may be filled with tobacco through the opening 32. The segment 28 extends into the recess 33 of the gear 7 and thus blocks the rack 10.

Figure 3:
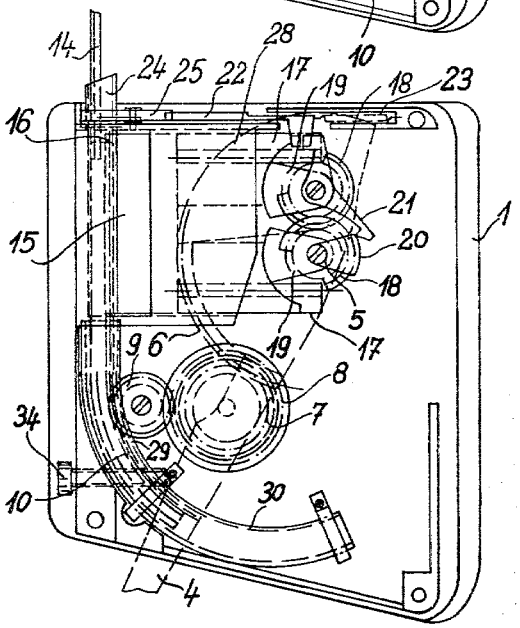
FIG. 3 is a view similar to FIG. 2 with the operating lever in the terminal position.

When the operating lever 4 is now turned clockwise into the position shown in FIG. 3, the gears 18 are turned, causing the geared rod 17 to move the pressure plate 16 into the tobacco magazine 15. Simultaneously, the cams 19 engage the rear of the pressure plate 16 and lock it in its compressive position. During the further pivotal motion of the operating lever, the segment 28 leaves the recess 33 of the pinion and the gear segment 6 engages the gear 7, thereby rotating gears 7, 8 and the pinion 9 and causing the rack 10 to move in the direction of the tobacco magazine 15 and to thereby expel the tobacco column through the holding boss 24 into a cigarette blank held thereon (not shown). The cigarette blank is held on the boss 24 by the aforementioned pincers 25. The apparatus can be adapted to accommodate cigarette blanks of various lengths by setting an adjustable stop screw 34 which limits the free rotational angle of the operating lever 4.

When the lever 4 returns, the rack 10 is moved into the position shown in FIG. 3 in which the engagement of the segment 28 with the recess 33 of the gear 7 blocks the rack 10. At the same time, the cams 19 release the pressure plate 16 and the cam 20 releases the pincers 25. Thereafter, the partial gears 18 move the geared rod 17 and hence the pressure plate 16 back into their initial position.

The gears 18 thus only provide for the displacement of the pressure plate 16, while the compression and locking of the pressure plate 16 is performed by the cams 19.

The amount of tobacco placed in the tobacco magazine may be adapted to a particular filter cigarette blank by the suitable positioning of a slide 11 which limits the filler opening 52 of the magazine 15, as may be seen in FIG. 1. The maximum displacement of the slide 11 corresponds approximately to the length of a single cigarette filter. By moving the cover slide 11, the amount of tobacco placed in the magazine 15 may be limited so that the length of the tobacco column formed by the action of the pressure plate 16 and the tab 14 is equal to that required in a dual-filter cigarette blank. This limitation prevents the exertion of unnecessarily high pressure on the tobacco column which would make the cigarette difficult to draw on. The adjustable slide mechanism 11 is capable of adaptation to various types of cigarette blanks.

Figure 4:
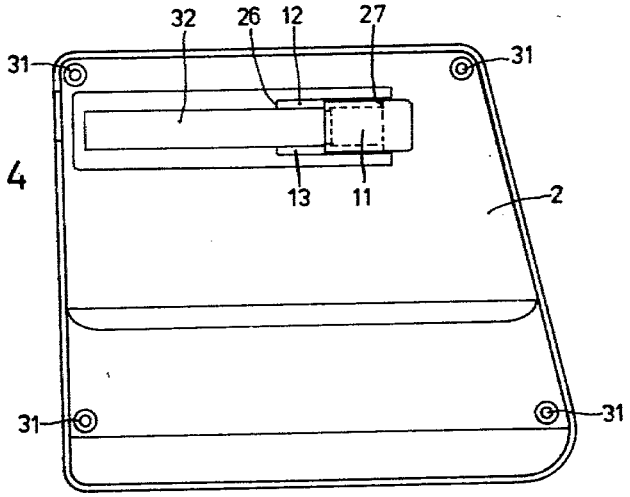
FIG. 4 is an internal view of the top of the housing.

In the embodiment illustrated in FIG. 4, the edges and ends of the opening 32 have grooves 12, 13 in which the slide 11 can move to and fro. These grooves may be formed, for example, as shoulders in the edge of the opening 32. The edge has terminal stops 26 and 27 which limit the longitudinal motion of the slide 11 in both directions.

The housing top 2 may be attached to the base by means of threaded bolts 31 which engage threads in the base 1.

In a variant of the embodiment shown in FIG. 4, the slide 11 may be disposed to move transversely to the long direction of the opening 32. In either case it is an important feature of the invention that the slide 11 does not interfere with the motion of the pressure plate 16, the tab 14 or the rack 10.

In a variant of the invention (not shown) the axial extent of the pressure plate 16 may be varied by constructing the pressure plate 16 so as to be capable of telescopic extension and shortening.

Figure 5:
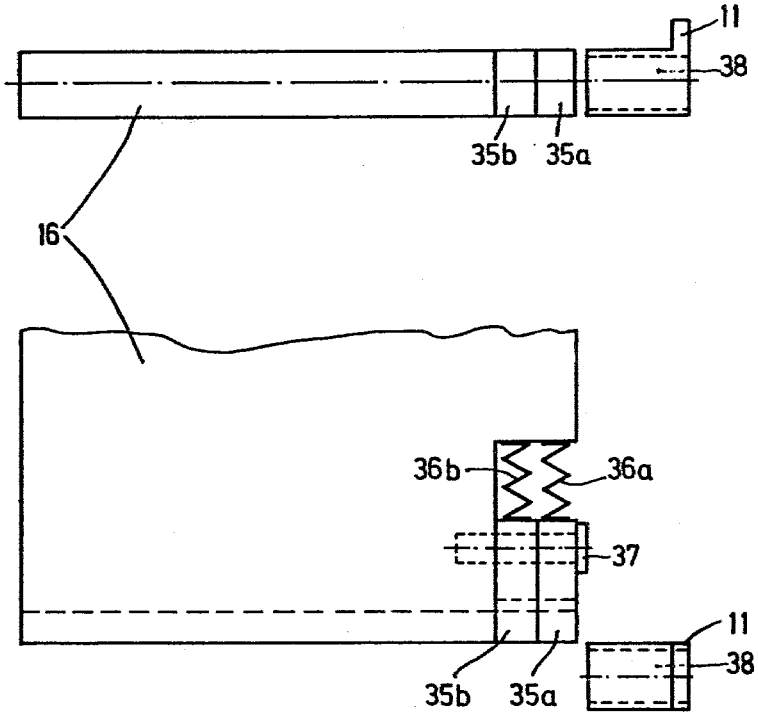
FIG. 5 is a front and top view of a pressure plate.

FIG. 5 is a front and top view of a pressure plate 16 wherein, according to a variant of the invention, a portion of the effective length, namely the front edge facing the tobacco magazine, can be partially shortened in telescopic manner. The right frontal area includes two rods 35*a*, 35*b* which can be moved perpendicular to the front edge of the pressure plate 16 and against the force of springs 36*a*, 36*b*, respectively, by means of a guide pin 37. The movement is performed by the slide 11 which has a channel 38 for receiving the rack 10 or the tab 14 as applicable.

If a cigarette blank having a double-length filter is to be filled with tobacco, the slide 11 in FIG. 5 is moved to the left by an amount equal to the length of that filter; this motion decreases the useable volume of the tobacco magazine 15. When the operating lever 4 is pivoted, the pressure plate 16 is moved forward as seen in the lower portion of FIG. 5, in a manner already described. Although the slide 11 lies in the space within which the pressure plate moves, it represents no obstacle to its advance because the corresponding part of the front edge of the pressure plate 16, i.e. the rod 35*a* (or rods 35*a*, 35*b*) is (are) pushed back toward the pressure plate 16 against the springs 36*a*, 36*b* while the remaining part of the front edge of the pressure plate 16 is able to compress the tobacco placed in the magazine 15. The slide 11 does not impede the motion of the rack 10 or the tab 14 because they can pass through the channel 28.

While the foregoing description relates to preferred exemplary embodiments of the invention, features of one embodiment may be used with those of any other and still other embodiments and variants can be made without departing from the spirit and scope of the invention.

I claim:

1. In an apparatus for filling cigarette blanks with tobacco, which includes a housing, a tobacco magazine having an opening through which tobacco may be placed therein, a moveable pressure plate moved by an operating lever and capable of exerting compressive forces on tobacco contained in the tobacco magazine and an expeller rack, moved by gears actuated by the operating rod, an improvement comprising movable limiting means for selectively limiting amount of tobacco placed in said tobacco magazine, said movable limiting means including a slide which is positioned and arranged partially to cover said opening in said tobacco magazine.

2. An improved apparatus according to claim 1, wherein said slide is displaceable in the same direction as the longitudinal extent of a tobacco column in said magazine when compressed.

3. An improved apparatus according to claim 1 or claim 2 wherein said slide is displaceable in a direction parallel to the extent of said opening in said tobacco magazine, on tracks provided with end stops which limit displacement of said slide to correspond to cigarette blanks of at least two different lengths.

4. An improved apparatus according to claim 1 or claim 2, wherein said pressure plate is partially capable of telescoping to change its extent depending on instant position of said slide.

5. An improved apparatus according to claim 1 or claim 2, further comprising a tubular base and pincer means for holding a cigarette blank on said tubular boss, said pincer means being actuated by said operating lever for engagement and release of the cigarette blanks.

* * * * *